US006366156B1

(12) United States Patent
Narendra et al.

(10) Patent No.: US 6,366,156 B1
(45) Date of Patent: Apr. 2, 2002

(54) FORWARD BODY BIAS VOLTAGE GENERATION SYSTEMS

(75) Inventors: Siva G. Narendra; Vivek K. De; Shekhar Y. Borkar, all of Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/451,661

(22) Filed: Nov. 30, 1999

(51) Int. Cl.[7] ..... G05F 1/10
(52) U.S. Cl. ..... 327/534; 327/537
(58) Field of Search ..... 327/534, 530, 327/535, 537, 538, 544

(56) References Cited

U.S. PATENT DOCUMENTS 5,461,338 A 10/1995 Hirayama et al. ..... 327/534
5,557,231 A 9/1996 Yamaguchi et al. ..... 327/534
5,814,899 A * 9/1998 Okumura et al. ..... 307/64

OTHER PUBLICATIONS

PCT Published Application WO 98/59419, "Forward Body Bias Transistor Circuits," De et al. Dec. 1998.

A. Annema, "Low–Power Bandgap References Featuring DTMOST's," IEEE Journal of Solid–State circuits, vol. 34, No. 7, Jul. 1999, pp. 949–955.

H. Banba et al., "A CMOS Band–Gap Reference Circuit with Sub 1V Operation," 1998 Symp. VLSI Circuits, Dig. Tech. Papers, 1998, pp. 228–229.

M. Gunawan et al., "A Curvature–Corrected Low–Voltage Bandgap Reference," IEEE Journal of Solid–State Circuits, vol. 28, No. 6, Jun. 1993, pp. 667–670.

J. Kao, "SOIAS Fro Temperature and Process Control," Massachusetts Institute of Technology, 6.374 project, Dec. 1996.

M. Miyazaki et al. "A Delay Distribution Squeezing Scheme with Speed–Adaptive Threshold–Voltage CMOS (SA–Vt CMOS) for Low Voltage LSIs," 1998 International Symposium on Low Power Electronics and Design Proceedings, pp. 48–53, 1998.

T. Kuroda et al., "A 0.9–v, 150–MHz, 10–m W, 4mm2, 2–D Discrete Cosine Transform Core Processor with Variable Threshold–Voltage (VT) Scheme," IEEE J. of Solid–State Circuits, vol. 31, No. 11, Nov. 1996, pp. 1770–1777.

* cited by examiner

*Primary Examiner*—Jung Ho Kim
(74) *Attorney, Agent, or Firm*—Alan K. Aldous

(57) ABSTRACT

In some embodiments, In some embodiments, the invention includes an electrical system having a functional unit block (FUB) including field effect transistors (FETs). A distributed forward body bias (FBB) voltage generation system provides at least one body bias signal to at least some of the FETs of the FUB such that the at least some of the FETs have a constant FBB. In some embodiments, the system includes a constant differential voltage generator and a distributed body bias generator to receive a set of differential signals from the constant differential voltage generator and provide at least one body bias signal to at least some of the FETs of the FUB such that the at least some of the FETs have a constant forward body bias. In some embodiments, the system includes multiple body bias generators coupled to corresponding FUBs receive a set of differential signals from a single constant differential voltage generator. In other embodiments, multiple constant differential voltage generators provide multiple sets of differential signals to multiple body bias generators coupled to corresponding FUBs. Without the invention, significant changes in the FBB of FETs in different FUBs can induce a new source of variation which can nullify the advantages of FBB and actually increase parameter variations between FETs of different FUBs.

37 Claims, 7 Drawing Sheets

200

FORWARD BODY BIAS VOLTAGE GENERATION SYSTEMS

BACKGROUND OF THE INVENTION

1. Technical Field of the Invention

The present invention relates to circuits and, more particularly, to a voltage generation system to provide forward body bias (FBB) to transistors.

2. Background Art

Forward body biasing reduces process induced variations in short channel field effect transistors (FETs). N-channel FETs (NFETs) have sources, drains, and bodies with voltages Vsource, Vdrain, and Vbody. N-channel metal oxide semiconductor field effect transistors (NMOSFETs) are examples of NFETs. NFETs are zero body biased when Vbody=Vsource, reverse body biased when Vbody<Vsource, and forward body biased when Vbody>Vsource. The amount of FBB for NFETs is measured by Vbody−Vsource, which equals Vbody when Vsource is at ground (sometimes referred to as Vss). P-channel FETs (PFETs) have sources, drains, and bodies with voltages Vsource, Vdrain, and Vbody. P-channel metal oxide semiconductor field effect transistors (PMOSFETs) are examples of PFETs. PFETs are zero body biased when Vbody=Vsource, reverse body biased when Vbody>Vsource, and forward body biased when Vbody<Vsource. The amount of FBB for PFETs is measured by Vsource−Vbody, which equals Vcc−Vbody in cases where Vsource is at the power supply signal Vcc (sometimes referred to as Vdd).

The threshold voltage (Vt) of a FET decreases as the FET becomes more forward biased and increases as the FET becomes less forward biased or more reverse biased. The leakage of a FET increases as the FET becomes more forward biased and decreases as the FET becomes less forward biased or more reverse biased.

A well known technique for eliminating noise is to provide a signal is provided differentially on two conductors because noise tends to appear on both conductors equally. A receiver removes the difference between the signals, and noise appearing on both conductors is cancelled (rejected).

A variety of regulation circuits have been used to maintain a voltage and/or a current of a signal constant in the presence of changes in, for example, noise or load impedance.

SUMMARY

In some embodiments, the invention includes an electrical system having a functional unit block (FUB) including field effect transistors (FETs). A distributed forward body bias (FBB) voltage generation system provides at least one body bias signal to at least some of the FETs of the FUB such that the at least some of the FETs have a constant FBB.

In some embodiments, the system includes a constant differential voltage generator and a distributed body bias generator to receive a set of differential signals from the constant differential voltage generator and provide at least one body bias signal to at least some of the FETs of the FUB such that the at least some of the FETs have a constant forward body bias.

In some embodiments, the system includes multiple body bias generators coupled to corresponding FUBs receive a set of differential signals from a single constant differential voltage generator. In other embodiments, multiple constant differential voltage generators provide multiple sets of differential signals to multiple body bias generators coupled to corresponding FUBs.

In some embodiments, the system is included in a single integrated circuit. In other embodiments, the system is includes in multiple integrated circuits.

Additional embodiments are described and claimed.

BRIEF DESCRIPTION OF THE DRAWINGS

The invention will be understood more fully from the detailed description given below and from the accompanying drawings of embodiments of the invention which, however, should not be taken to limit the invention to the specific embodiments described, but are for explanation and understanding only.

DETAILED DESCRIPTION

Figure 1:
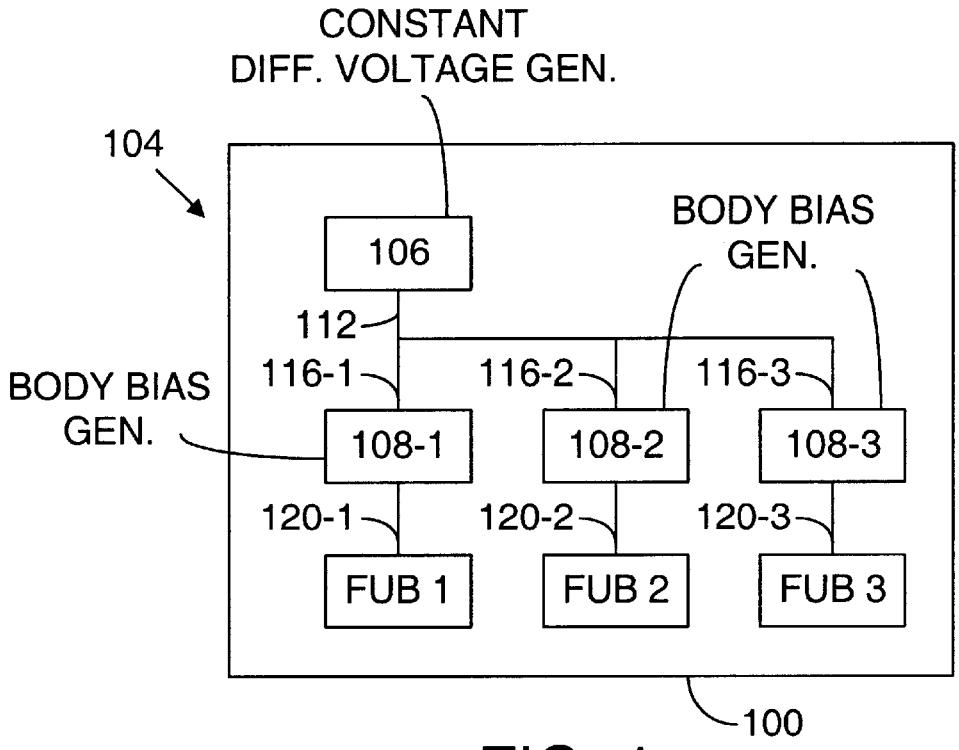
FIG. 1 is a schematic representation of an electrical system including a global distributed FBB voltage generation system according to some embodiments of the invention.

The invention involves FBB voltage generation systems to regulate the FBB provided to FETs so as to maintain the FBB constant. In some embodiments, the invention involves providing substantially the same FBB to transistors in different regions of an integrated circuit (IC) or different regions of a system involving multiple ICs. Through regulating the FBB, the FET transistors perform to specified levels (which may involve a tradeoff of switching speed and leakage). Further, parameter variations between FETs within a FUB and between different FUBs is reduced.

Without the invention, significant changes in the FBB of FETs in different FUBs can induce a new source of variation which can nullify the advantages of FBB and actually increase parameter variations between FETs of different FUBs. Further, individual FUBs may not perform to speed and/or leakage specifications. Overall IC and system performance may be reduced because the IC may have to perform to worst case specifications. Different phenomena may cause a FBB generation system (that does not include the circuitry of the invention) to provide different FBB voltages to different FUBs. Examples include: process change in different bias generation circuits, temperature change, supply or ground voltage noise, change in load current requirements from the bias generation circuit, and coupling noise. The invention provides a system to keep the FBB constant in the presence of these phenomena.

As used herein, "constant" does not mean perfectly constant but rather substantially constant. For example, power supply and ground voltages have fluctuations because of noise, changes in load, or other reasons. It may take the distributed body bias generators, described below, a certain amount of time to respond to these fluctuations. Further, FET mismatches or other factors may cause temperature dependencies or other dependencies that prevent the FBB from being perfectly constant. In some embodiments, there may be substantial value in using FBB even if the actual FBB is ±10% or more of a target FBB, although it would be desirable to have a much more narrow range around a target FBB.

Distributed FBB Voltage Generation Systems

There are a variety of embodiments of a distributed FBB voltage generation system according to the invention. For example, referring to FIG. 1, an electrical system 100 includes a global distributed FBB voltage generation system 104 having a central constant differential voltage generator 106 coupled to distributed body bias generators 108-1, 108-2, and 108-3. Distributed body bias generators 108-1, 108-2, and 108-3 are coupled to bodies of transistors of functional unit blocks (FUBs) FUB 1, FUB 2, and FUB 3 through conductors 120-1, 120-2, and 120-3. In different embodiments, the transistors that are biased may be some or all PFETs in the FUB, some or all NFETs in the FUB, or some or all of both the PFETs and NFETs in the FUB.

The term FUB is used loosely to mean a collection of transistors and is not intended to have a specialized or restrictive meaning. Conductors 112 are joined to conductors 116-1, 116-2, and 116-3. In different embodiments of the invention, there are a different number of conductors included in conductors 112, 116-1, 116-2, and 116-3, and different signals are associated with the conductors. There may be repeaters (not shown) between generator 106 and generators 108-1, 108-2, and 108-3 to maintain voltages on the conductors 112, 116-1, 116-2, and 116-3. That is, conductors, 112, 116-1, 116-2, and/or 116-3 might not be continuous as illustrated.

Figure 2:
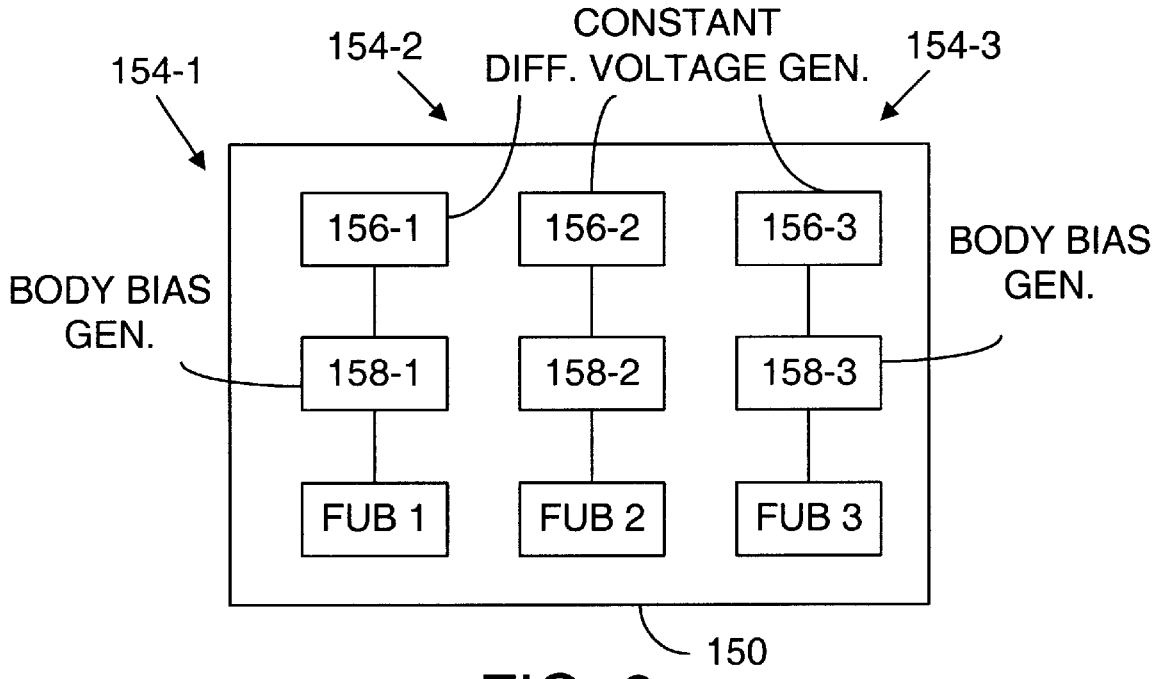
FIG. 2 is a schematic representation of an electrical system including separate local distributed FBB voltage generation systems according to some embodiments of the invention.

FIG. 2 illustrates an electrical system 150 which includes multiple local distributed FBB voltage generation systems 154-1, 154-2, and 154-3 coupled to FUBs 1, 2, and 3, respectively, in contrast to global distributed FBB voltage generation system 104 in FIG. 1. Referring to FIG. 2, local distributed FBB voltage generation system 154-1 includes constant differential voltage generator 156-1 and distributed body bias generator 158-1. Likewise, local distributed FBB voltage generation systems 154-2 and 154-3 include constant differential voltage generators 156-2 and 156-3 coupled to distributed body bias generators 158-2 and 158-3, respectively. Constant differential voltage generators 156-1, 156-2, and 156-3 each may be the same as or different than constant differential voltage generator 106. Distributed body bias generators 158-1, 158-2, and 158-3 may be the same as or different than distributed body bias generators 108-1, 108-2, and 108-3.

Figure 3:
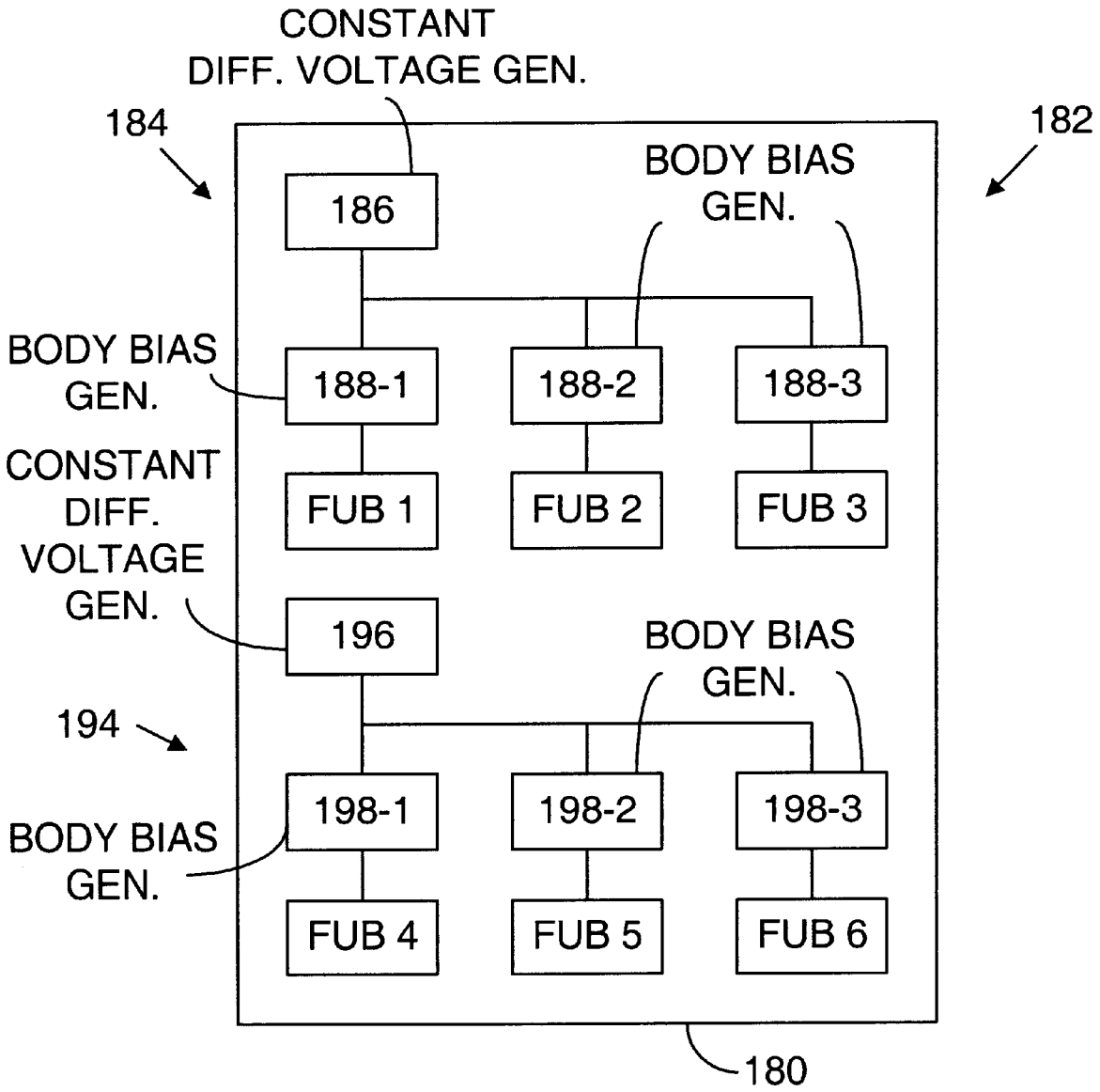
FIG. 3 is a schematic representation of an electrical system including partially global distributed FBB voltage generation systems according to some embodiments of the invention.

An advantage separate local distributed FBB voltage generations systems 154-1, 154-2, and 154-3 is they avoid the space of routing long conductors 112, 116-1, 116-2, and/or 116-3, which can be considerable. An advantage of a single global distributed FBB voltage generation system 104 of FIG. 1 is that it has only one constant differential voltage generator rather than three, which takes less space. A compromise between these systems is partially global distributed FBB voltage generation system 182 in an electrical system 180, illustrated in FIG. 3. System 182 includes a partially global distributed FBB voltage generation system 184 coupled to FUBS 1, 2, and 3, and a partially global distributed FBB voltage generation system 194 coupled to FUBS 4, 5, and 6. Constant differential voltage generator 186 and 196 may be the same as or different than constant differential voltage generator 106 and distributed body bias generators 188-1, 188-2, 188-3, 198-1, 198-2, and 198-3 may be the same as or different than distributed body bias generators 108-1, 108-2, and 108-3. Another example of a distributed FBB voltage generation system would be the combination of the distributed system of FIG. 1 or FIG. 3, with the addition of one or more local FBB voltage generation systems, as shown in FIG. 2. The layout shown in FIGS. 1–3 is purely for convenience in preparing drawings. In practice, the layout could be different. For example, the constant differential voltage generator could be in the center of a FUBs in a hub/spoke fashion to reduce conductor length. The sizes and shapes of boxes in the figures does not suggest actual size and shapes.

The distributed body bias generators (e.g., 108-1) of FIGS. 1–3 are called distributed because they are distributed between a corresponding constant differential voltage generator a corresponding FUB and they provide at least one FBB signal to the FUB as a function of differential signals provided by the constant differential voltage generator. A distributed body bias generator may provide bias signals for more than one FUB (e.g., see FIG. 13 and related discussion).

The constant differential voltage generator provides a set of differential signals to distributed body bias generators. In different embodiments, the set of differential signals may include difference signals. Examples include a single pair of differential signals, a three-some of differential signals, or more than one pair of differential signals. The different distributed body bias generators may receive the same set of differential signals or different sets of differential signals.

In actual practice, electrical system 150 may include greater or lesser number of local FBB voltage generator systems than are shown in FIG. 2. Electrical system 180 may include a greater number of distributed body bias generators than are shown in FIG. 3. Electrical systems 100, 150, and 180 each may be a single integrated circuit (IC or chip) or comprise more than one IC. For example, central constant differential voltage generator 106 may be on one IC, while distributed body bias generators 108-1, 108-2, and 108-3 may be on another IC or they could be on the same IC. Of course, electrical systems 100, 150, and 180 may include components in addition to those illustrated in the figures. Electrical systems 100, 150, and 180 could be any of a various types of electrical devices including a microprocessor, DSP (digital signal processor), embedded controller, ASIC (application specific integrated circuit), communication chip, multi-chip computer systems, and multi-chip communication systems, etc.

A FBB voltage generation system according to the present invention does not necessarily always provide the same FBB or any FBB to the FETs. For example, it could include the ability to provide different body bias levels while the FUB or over IC is in different modes. For example, in a high performance mode, the FBB voltage generation system may provide a high FBB the FETs, while in a low power mode, the FBB voltage generation system might provide a lower FBB, a zero body bias, or even a reverse body bias. In some extreme low power modes, the FBB voltage generation system may shut down. However, within a particular FBB mode, the FBB is constant.

Figure 4:
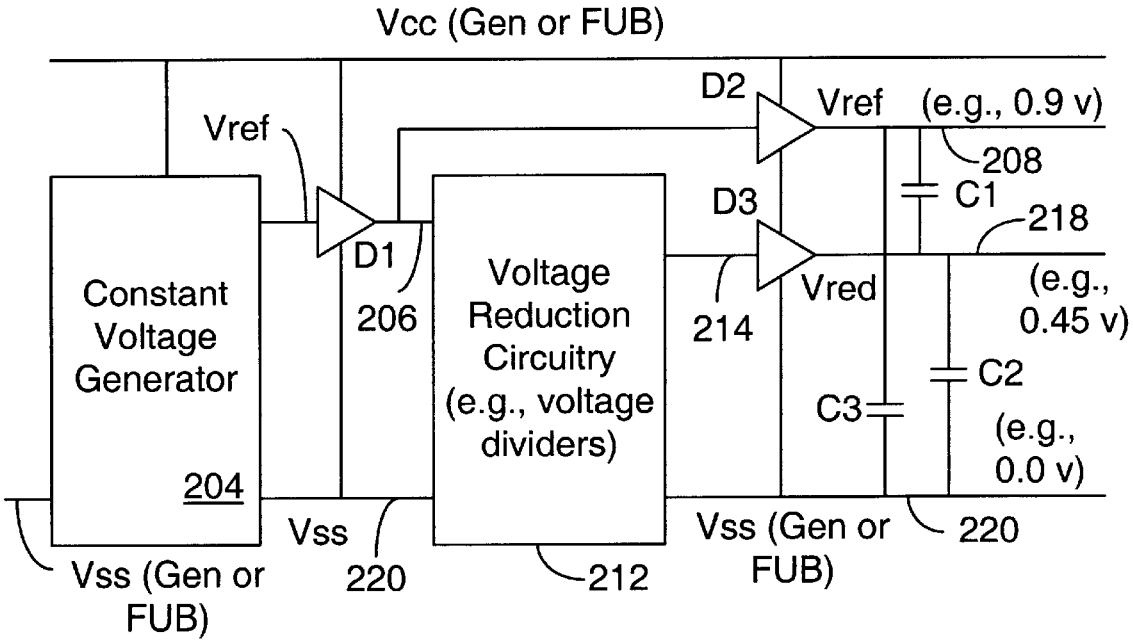
FIG. 4 is a schematic representation of circuitry included in some embodiments of the constant differential voltage generators of FIGS. 1–3.

Constant Differential Voltage Generators and Distributed Body Bias Generators There are various embodiments of the constant differential voltage generators of FIGS. 1–3. As an example, FIG. 4 illustrates circuitry 200 that may be included in a constant differential voltage generator, such as one or more of generators 106, 156-1, 156-2, 156-3, 186, and 196 of FIGS. 1–3. However, a constant differential voltage generator according to the present invention is not restricted to these details and may include additional circuitry. Circuitry 200 includes a constant voltage generator 204 which produces a reference voltage Vref which is temperature and process independent. As an example, constant voltage generator 204 may include a traditional bandgap circuit or a low voltage bandgap circuit. Analog drivers D1 and D2 may be used to increase the drive current of Vref and provided it to node 208. Vref is also provided by driver D1 to voltage reduction circuitry 212, which is preferably essentially temperature and process independent. Voltage reduction circuitry 212 provides a reduced voltage signal Vred. Analog driver D3 may be used to increase the drive current of Vred and provide it to node 218. A decoupling capacitor C1 may be positioned between nodes 208 and 218. A decoupling capacitor C2 may be included between nodes 218 and 220. A decoupling capacitor C3 may be positioned between nodes 208 and 220.

A ground signal (Vss) is provided on node 220. The ground signal of a constant differential voltage generator be the same as or different than (e.g., electrically isolated) the ground signal of a FUB (referred to as Vss(FUB)). If the ground signal of the generator is the same as that of the FUB, it is referred to as Vss(FUB). If the ground signal of the generator is different, it is referred to as Vss(Gen). Since in different embodiments the Vss of the generator may be either Vss(Gen) or Vss(FUB), it is referred to as Vss (Gen or FUB). Likewise, the power supply signal (Vcc) of the generator may be the same as or different than the power supply signal of a FUB (referred to as Vcc(FUB)). If the same as, it is referred to as Vss(FUB). If different, it is referred to as Vcc(Gen). It is therefore referred to as Vcc (Gen or FUB). An advantage of having a different ground and power supply signals for the generator is it may have less noise.

In some embodiments, signals Vref and Vred are provided differentially to a distributed body bias generator, such as one or more of those illustrated in FIG. 1–3, which in turn provides a body bias signal Vbbp for PFETs, where Vcc (FUB)−Vbbp=Vref−Vred. Likewise, Vred and Vss may be provided differentially to the distributed body bias generator (e.g., 108-1), which in turn provides a body bias signal Vbbn for NFETs, where Vbbn−Vss(FUB)=Vred−Vss (Gen or FUB). In different embodiments, the set of differential signals may include different signals. Examples include Vref and Vred; Vred and Vss; Vref, Vred, and Vss; Vref and Vred1, Vred2 and Vss. There are other possibilities.

Figure 5:
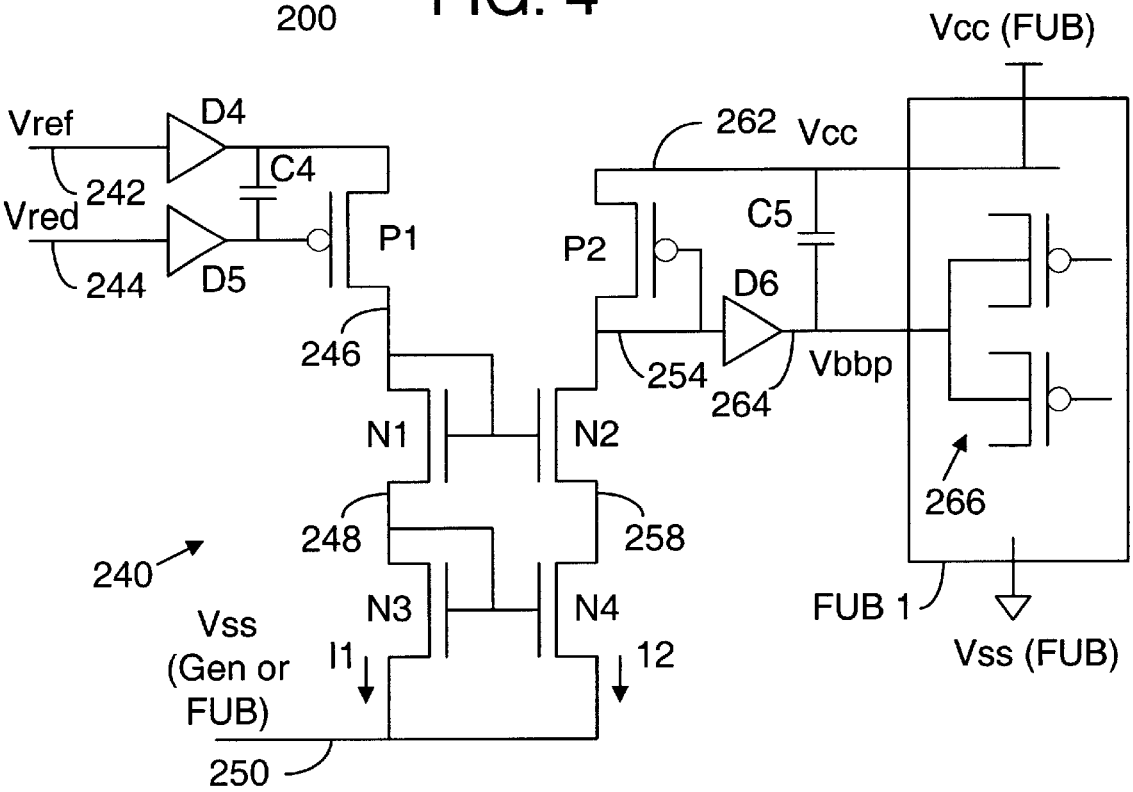
FIG. 5 is a schematic representation of mirror circuitry included in some embodiments of the body bias generators of FIGS. 1–3.
Figure 6:
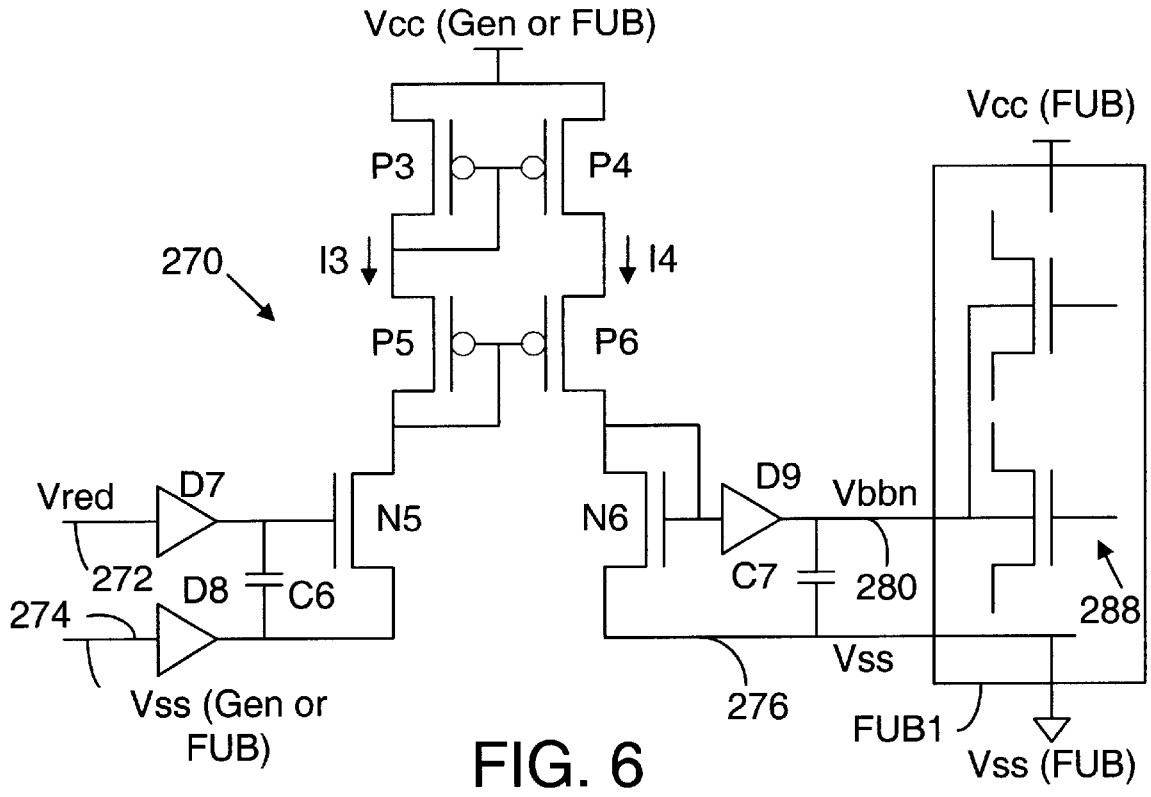
FIG. 6 is a schematic representation of mirror circuitry included in some embodiments of the body bias generators of FIGS. 1–3.

FIG. 5 illustrates mirror circuitry 240 to provide Vbbp and FIG. 6 illustrates mirror circuitry 270 to provide Vbbn. In a particular embodiment, if both Vbbp and Vbbn are desired for a FUB, then mirror circuitry 240 and 270 may be included in a corresponding distributed body bias generator. As an example, assume that FUB 1 in FIG. 1 includes PFETs and NFETs that are to be forward body biased and distributed body bias generator 108-1 includes both circuitry 240 and 270. In this example, conductors 112 and 116-1 include at least signals Vss, Vref and Vred from constant differential voltage generator 106, and conductors 112 and 116-1 include at least signals Vbbp and Vbbn.

Referring to FIG. 5, drivers D4 and D5 of mirror circuitry 240 receive signals Vref and Vred at node 242 and 244. Depending on the embodiment, node 242 of circuitry 240 may be the same as or different than node 208 in FIG. 4. For example, there may be an analog repeater(s) on conductors 112 and/or 116-1 between nodes 208 and 242. Or, there could be a continuous conductor between nodes 208 and 242. Likewise, node 244 of FIG. 5 carrying Vred may be the same or different than node 218 in FIG. 4. Node 250 of FIG. 5 carrying a ground signal Vss may be the same as or different than node 220 of FIG. 4.

In the illustrated embodiment, mirror circuitry 240 converts voltage to current followed by current to voltage. The source to gate voltage of PFET P1 sets the current I1 through diode connected NFETs N1 and N3. P1 may be chosen to have a long channel so its Vt is relatively small. Current I1 sets the drain-to-source voltage for N1 (between nodes 246 and 248) and the drain-to-source voltage for N3 (between nodes 248 and 220). The drain-to-source voltage for N1 is equal to the gate-to-source voltage for N1. NFET N4 has the same size and Vt as N3 and has the same drain-to-source voltage as does N3. Further, NFET N2 has the same size and Vt as N1 and has the same drain-to-source voltage as does N1. (There will, of course, be some mismatch between FETs (e.g., N1 and N2 will not perfectly match).) Therefore, current 12 through NFETs N2 and N4 equals I1. (In some embodiments, N1, N2, N3, and N4 have the same size and Vt.)

In response to current I2, diode connected PFET P2 sets a voltage drop from its source to drain (node 262 to node 254), where Vbbp is at node 254. An analog driver D6 may be used to increase the drive current of Vbbp and provides it to node 264, which is coupled to bodies of PFETs of FUB 1. (There may be repeaters (not shown) in FUB 1 to provide the Vbbp to different FETs.) For example, if Vref−Vred=450 mV, then Vcc−Vbbp would be 450 mV and the PFETs would be forward body biased by 450 mV. Circuit 240 causes Vcc−Vbbp to equal Vref−Vred at low frequencies. If there is high frequency noise on the signals, the circuit may not be able to respond fast enough. Decoupling capacitors C4 and C5 may be included to help circuit 240 respond quickly with high frequency noise.

Circuit 270 of FIG. 6 operates in a similar manner to circuit 240 of FIG. 5. Referring to FIG. 6, the voltage Vred sets the drain-to-source voltage of NFET N5, which sets the current 13 through diode connected PFETs P3 and P5. PFET P4 has the same size and Vt as P3 and PFET P6 has the same size and Vt as P5. Accordingly, current I4 through P4, P6, and NFET N6 equals current 13. The gate of diode connected N6 is at Vbbn so that Vbbn−Vss(FUB) on node 276 equals Vred−Vss at nodes 272 and 274. Analog drivers D7, D8, and D9 may be used to increase drive current. Decoupling capacitors C6 and C7 may be used. Again, for example, if Vred is 450 mV above Vss, Vbbn will be 450 mV above the Vss (FUB).

Voltage Dividers

As mentioned above, voltage reduction circuitry 212 may reduce voltage through a voltage divider(s). For example, referring to FIGS. 4 and 7, in some embodiments, voltage reduction circuitry 212 includes a voltage divider circuit 300 having PFETs P10 and P11 in series between nodes 206 (Vref) and 220 (Vss). P10 and P11 are equally sized and fabricated to make Vred on node 302 equal to Vref/2. Node 302 may be the same as node 204 or separated from node 204, as described below. PFETs P10 and P11 are illustrated as being zero biased by coupling the body to the source, but could be forward biased or reverse biased. FIG. 8 shows a voltage divider circuit 304, which may be included in voltage reduction circuitry 212. Voltage divider circuit 304 includes NFETs N10 and N11 in series between nodes 206 (Vref) and 220 (Vss). N10 and N11 are equally sized and fabricated to make Vred on node 302 equal to Vref/2. NFETs N10 and N11 are illustrated as being zero biased by coupling the body to ground, but could be forward biased or reverse biased. For p-substrate, n-well fabrication, voltage divider circuit 300 may be preferred over voltage divider circuit 304 for the following reason. The bodies of P10 and P11 may be in different n-wells, so they are electrical isolated. However, the bodies of N10 and N11 may be shorted to node 220 in the p-substrate. As the temperature changes, the division characteristics may change with voltage divider circuit 304. With n-substrate, p-well fabrication, the NFET divider 304 may be preferred. If the bodies of N10 and N11 may be shorted to different electrically isolated p-wells in p-substrate, then they may be more resistant to temperature changes. Note that in FIGS. 7 and 8, there may be more than two FETs in series (e.g., 3 or 4) and still provide temperature independence.

Referring to FIGS. 1, 4, and 5, as an example, assume that the desired FBB for both NFETs and PFETs in FUB 1 is 450 mV. The desired FBB could be achieved where Vcc(FUB)= 1.0V, Vref=900 mV, Vred=450 mV, and Vss=0 mV. Mirror circuit 240 causes Vcc(FUB)=Vbbp to equal Vref−Vred. In this example, Vref−Vred=900−450 mV. Therefore, Vcc−Vbbp will be 450 mV. Referring to FIG. 6, mirror circuit 270 causes Vbbn−Vss(FUB or Gen) to equal Vred−Vss(FUB)= Vred=450 mV. Accordingly, the FBB is 450 mV as desired.

Now consider the case in which the desired FBB for both PFET and NFET is still 450 mV, but for whatever reason, Vref is other than 900 mV. For example, assume Vref is 1.25V.

Figure 7:
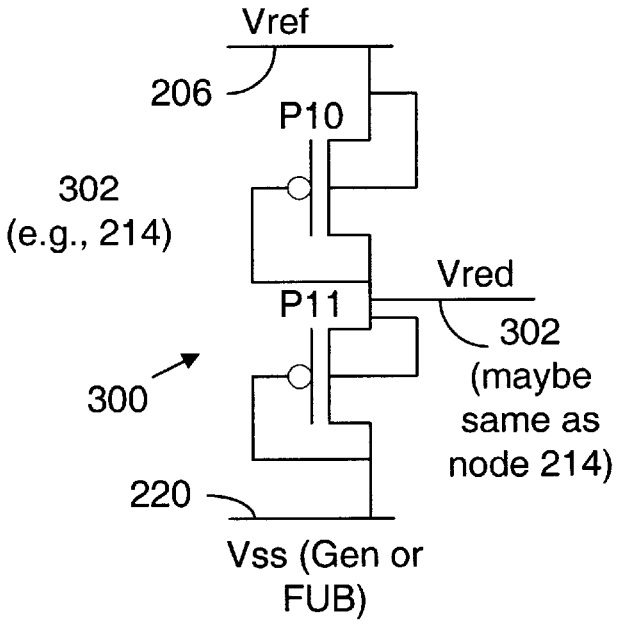
FIG. 7 is a schematic representation of voltage divider circuitry that may be used in some embodiments of the circuitry of FIG. 4.
Figure 8:
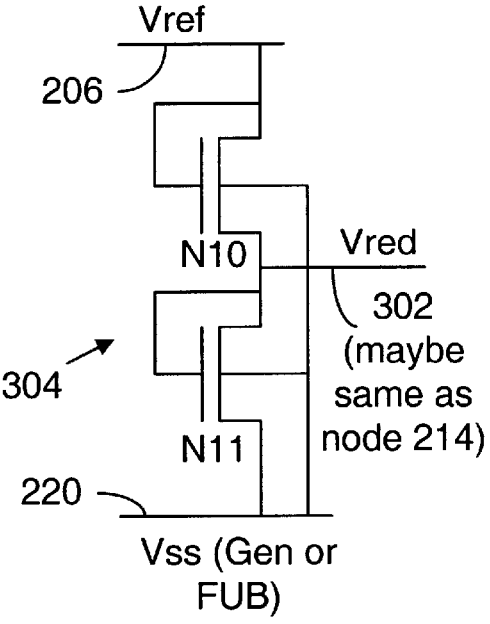
FIG. 8 is a schematic representation of voltage divider circuitry that may be used in some embodiments of the circuitry of FIG. 4.
Figure 9:
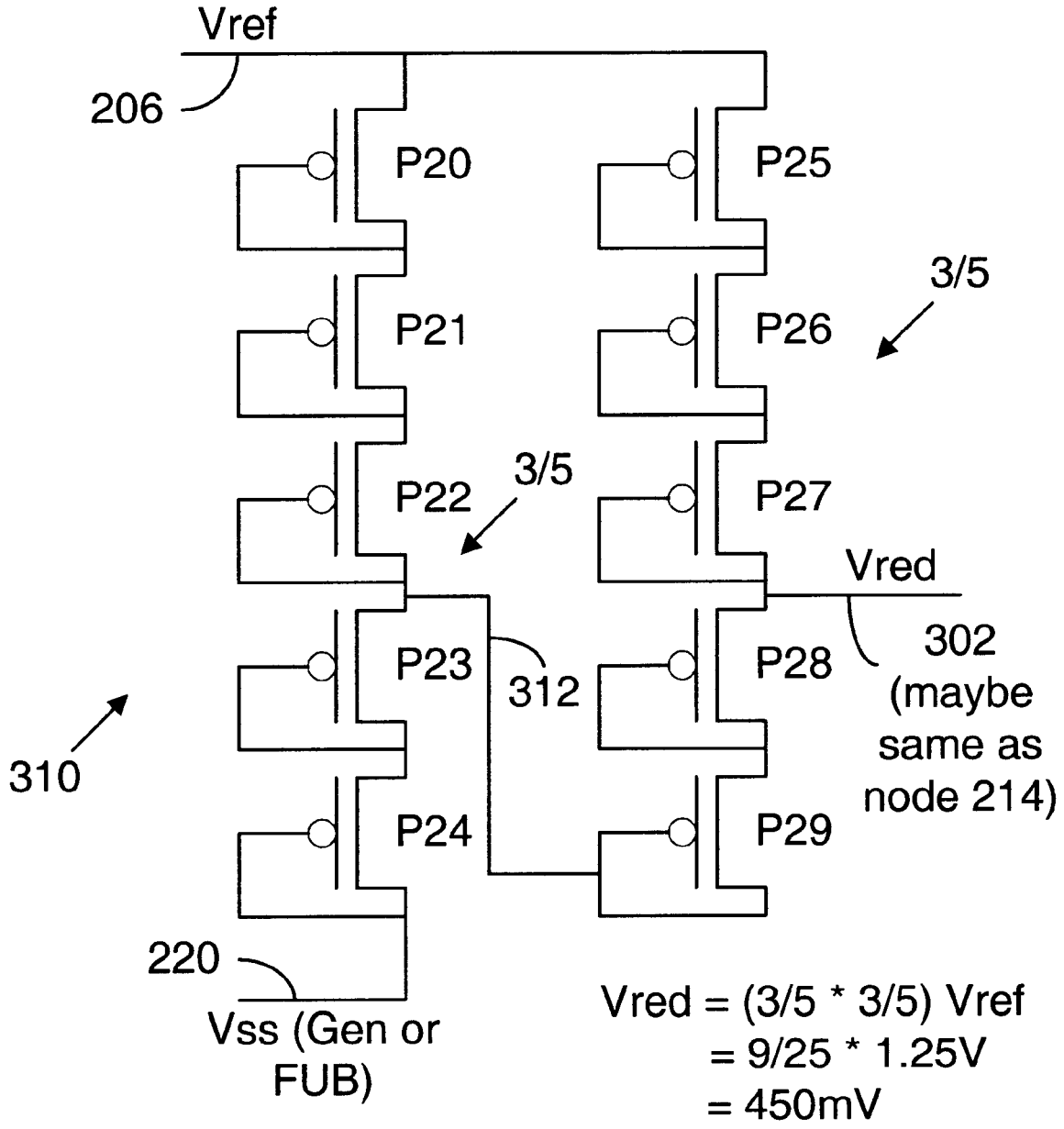
FIG. 9 is a schematic representation of voltage divider circuitry that may be used in some embodiments of the circuitry of FIG. 4.

In that case, if the Vref voltage were evenly divided as in FIG. 7, Vred would equal 625 mV and the desired 450 mV FBB would not be achieved. One solution is to have a voltage reduction circuitry 212 include a hierarchical divider circuit 310 having a first branch (including PFETs P20, P21, P22, P23, and P24) between nodes 206 and 220 and a second branch (including PFETs P25, P26, P27, P28, and P29) between a node 206 and a node 312. Node 312 is between P22 and P23. This 450 mV with respect to Vss can be used to bias NFETs through distributed body bias generators. Similar hierarchical voltage divider techniques can be used to generate, for example, 800 mV (=4/5 * 4/5 * 1.25 mV). The voltage difference of 450 mV between 1.25V and 800 mV can be used to bias PFETs through the distributed body bias generators. Note that hierarchical voltage division can have just one level of voltage division in which case FIG. 9 may look like FIG. 7.

Generally, having transistors of different sizes causes the voltage reduction circuitry to produce a different Vred as temperature or other factors changes. However, using transistors of different sizes in a voltage divider circuitry will allow a smaller number of transistors, but may give almost the desired Vred and not much change in Vred with temperature or other changes.

Figure 10:
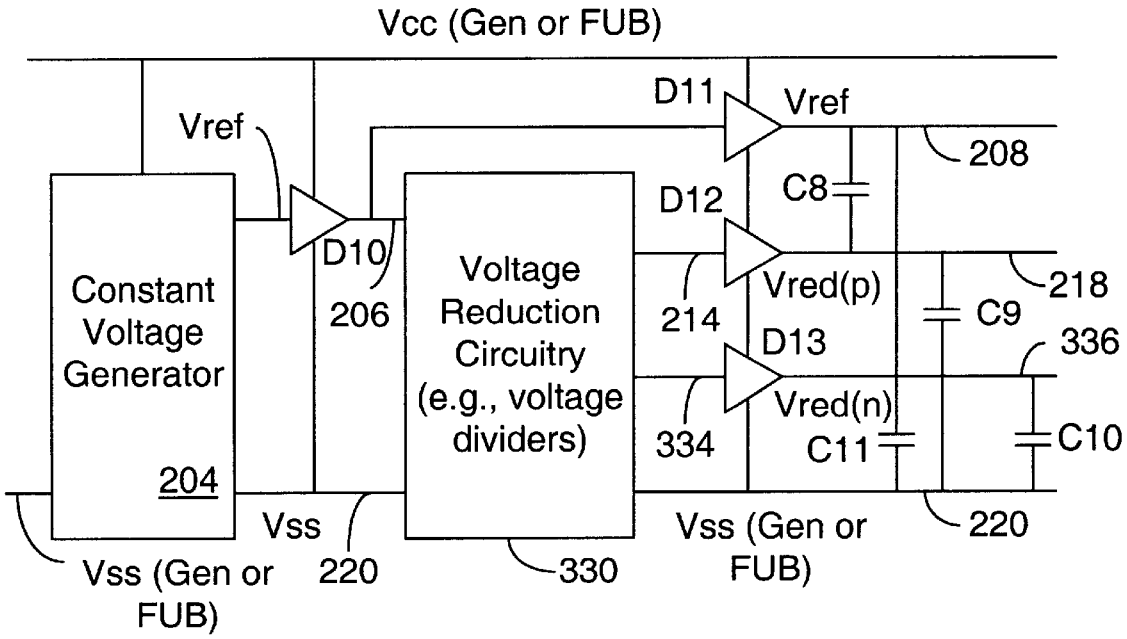
FIG. 10 is a schematic representation of circuitry included in some embodiments of the constant differential voltage generators of FIGS. 1–3.

Now consider the case in which it is desired that the FBB for PFETs is different than the FBB for NFETs. Referring to FIG. 10, in such a case, voltage reduction circuitry 330 produces two reduced voltages: Vred(p) at node 214 and Vred(n) at node 334, which may be provided through analog drivers D12 and D13 to nodes 218 and 336. Drivers D10 and D11 may also be used. As an example, signal Vred(p) is provided through node 218 to node 244 of mirror circuit 240, shown in FIG. 5, and signal Vred(n) is provided through node 336 to node 272 of mirror circuit 270, shown in FIG. 6. Voltage reduction circuitry may include two independent voltage divider circuits or one voltage divider circuit (e.g., a hierarchical divider circuit) with taps at different places for Vred(p) and Vred(n). Decoupling capacitors C8. C9, C10, and C11 may be included to help with high frequency noise.

Figure 11:
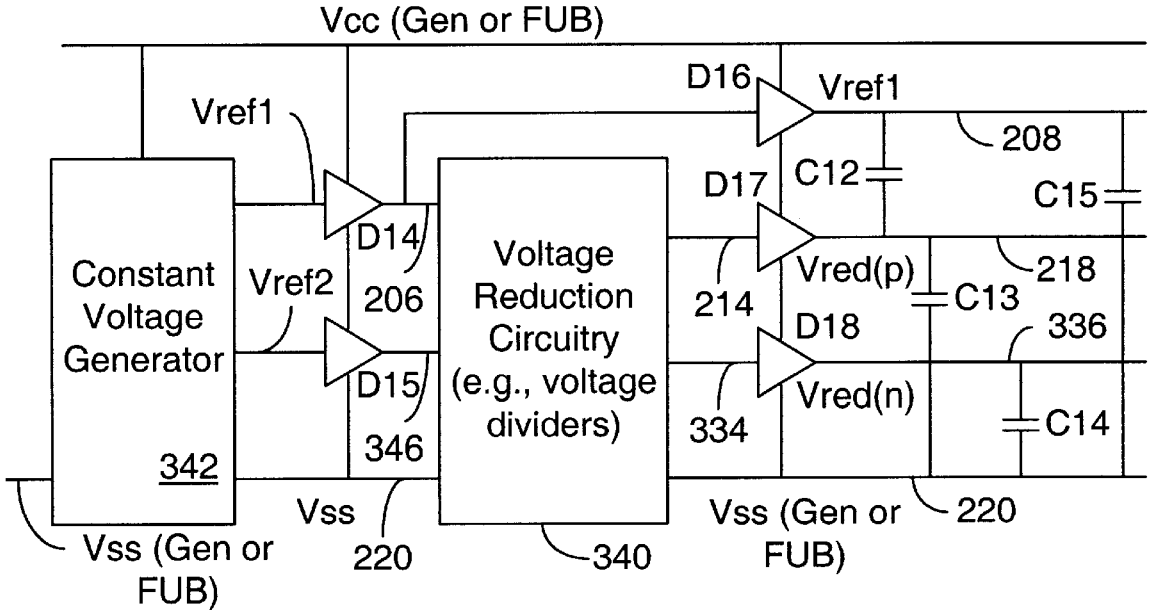
FIG. 11 is a schematic representation of circuitry included in some embodiments of the constant differential voltage generators of FIGS. 1–3.

FIG. 11 is similar to FIG. 10, except that constant voltage generator 342 provides two reference signals: Vref1 and Vref2. Vref1 is used by voltage reduction circuitry to create Vred(p) on node 214 and Vref2 is used by voltage reduction circuitry 340 to create Vred(n) for node 334. Drivers D17 and D18 may provide Vred(n) and Vred(p) to nodes 218 and 336. Drivers D14, D15, and D16, capacitors C12, C13, C14, and C15 may also be included.

Figure 12:
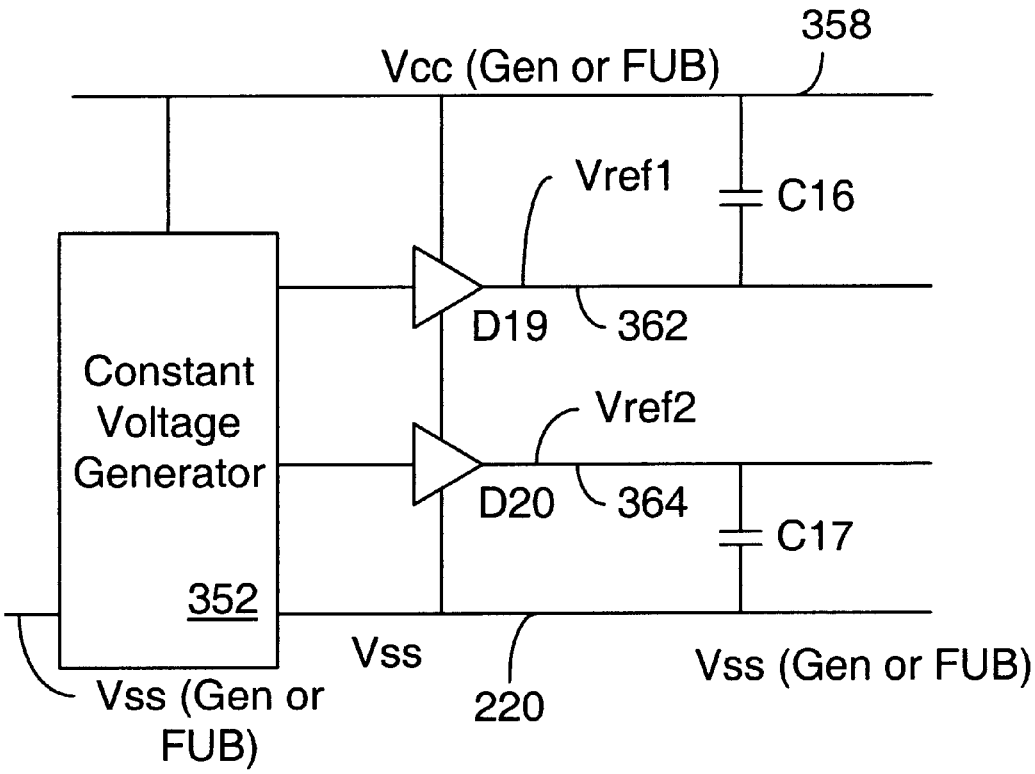
FIG. 12 is a schematic representation of circuitry included in some embodiments of the constant differential voltage generators of FIGS. 1–3.

FIG. 12 illustrates yet another example of a constant different voltage generator. A constant voltage generator 352 provides two voltage reference signals Vref1 and Vref2 (the drive current of which is increased on nodes 362 and 364 by drivers D19 and D20). As an example, the Vcc and Vref1 signals on nodes 358 and 362 can be provided as the Vref and Vred signals on nodes 242 and 244, respectively, of distributed body bias generator 240 in FIG. 5. Further, the Vref2 and Vss signals on nodes 364 and 220 can be provided as the Vred and Vss signals on nodes 272 and 274, respectively, of distributed body bias generator 270 in FIG. 6. As an example, Vref1 may be the desired FBB amount (e.g., 450 mV) below Vcc and Vref2 may be the desired FBB amount above Vss. As an example, constant voltage generator 352 may involve multiple band gap circuits to produce Vref1 and Vref2. Additional drivers may be used. Decoupling capacitors C16 and C17 may be included. One or more additional decoupling capacitors (e.g., between nodes 362 and 220 and/or between nodes 358 and 220) may be used. Note that constant voltage generator 352 might have provided only Vref1 to body bias only PFETs or provided only Vref2 to body bias only NFETs. Constant voltage generator 352 may have different modes.

Figure 13:
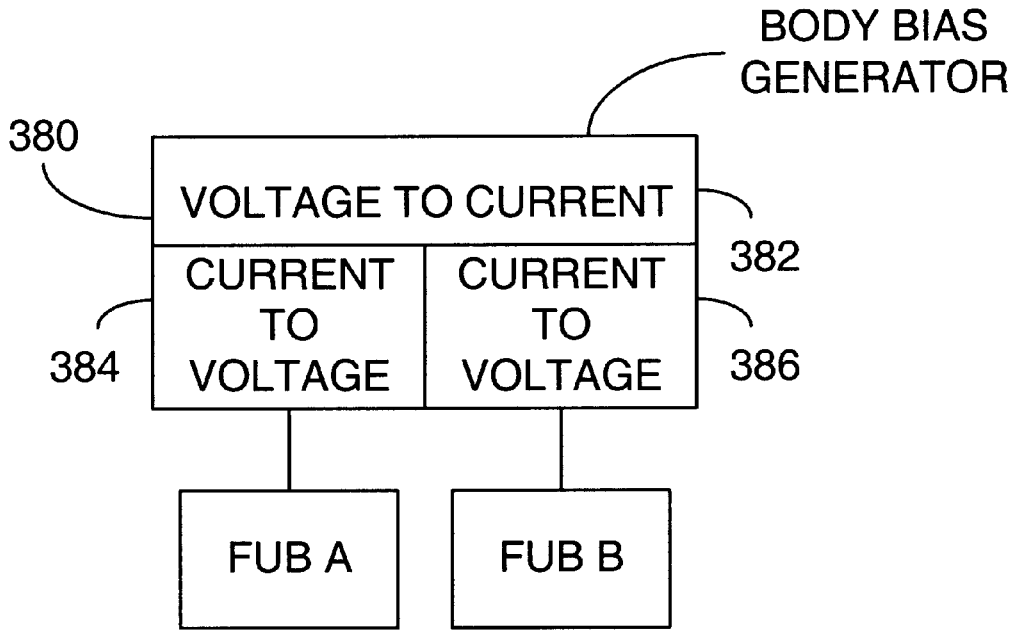
FIG. 13 is a schematic representation of mirror circuitry with multiple current to voltage sections to control body bias voltages to multiple FUBs according to some embodiments of the invention.

Note that circuits 240 and 270 in FIGS. 5 and 6 could be modified so that there are multiple current to voltage circuit sections for one voltage to current circuit section. For example, as illustrated in FIG. 13, a distributed body bias generator 380 (which could provide FBB signals to either NFETs or PFETs) has one voltage to current circuit 382 and two corresponding current to voltage circuits 384 and 386, which provide body signals to FUBs A and B, respectively. Such an arrangement could be included in the systems of FIGS. 1–3.

Other Information and Embodiments

The various drivers mentioned may be precision analog drivers to increase driver current while maintaining voltage. The various drivers and decoupling capacitors illustrated in the drawings are optional. That is, some or all of them could be not included or replaced by other components. Additional drivers and/or decoupling capacitors could be included. For example, decoupling capacitors may be included between Vcc and Vss.

In FIGS. 4, 10, and 11, drivers are shown attached to vertical lines. The lines represent power and ground lines, which may be provided to each of the drivers.

As mentioned, in different modes, there may be different levels of body bias. In some embodiments, constant voltage generators 204 or 342 may provide different reference signals in some different modes. In some embodiments, voltage reduction circuitry 212, 330, and 340 may provide no voltage reduction or different voltage reductions in some different modes.

FETs other than MOSFETs could be used. Although the illustrated embodiments include enhancement mode transistors, depletion mode transistors could be used with modifications to the circuit which would be apparent to those skilled in the art having the benefit of this disclosure. Unless shown or stated otherwise, the FETs of the various circuits (e.g., generators) may be zero biased, forward biased, or reverse biased.

Reference in the specification to "an embodiment," "one embodiment," "some embodiments," or "other embodiments" means that a particular feature, structure, or characteristic described in connection with the embodiments is included in at least some embodiments, but not necessarily all embodiments, of the invention. The various appearances "an embodiment," "one embodiment," or "some embodiments" are not necessarily all referring to the same embodiments.

If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Those skilled in the art having the benefit of this disclosure will appreciate that many other variations from the foregoing description and drawings may be made within the scope of the present invention. Accordingly, it is the following claims including any amendments thereto that define the scope of the invention.

What is claimed is:

1. An electrical system, comprising:

a first functional unit block (FUB) including field effect transistors (FETs);

a second FUB including FETs;

a constant voltage generator;

a distributed forward body bias (FBB) voltage generation system including first and second body bias generators receiving signals from the constant voltage generator to provide at least one body bias signal to at least some of the FETs of the first FUB such that the at least some of the FETs of the first FUB have a constant FBB and at least one body bias signal to at least some of the FETs of the second FUB such that the at least some of the FETs of the second FUB have a constant FBB.

2. The electrical system of claim 1, wherein the distributed FBB voltage generation system is a global distributed FBB voltage generation system and the electrical system includes additional FUBs including FETs for which the global distributed FBB voltage generation system provides at least one body bias signal such that the FETs of the additional FUBs have a constant FBB.

3. The electrical system of claim 1, wherein the distributed FBB voltage generation system is a partially global distributed FBB voltage generation system and the electrical system further comprises at least one additional partially global distributed FBB voltage generation system.

4. The electrical system of claim 1, further wherein the distributed FBB voltage generation system is a local distributed FBB voltage generation system and the electrical system further comprises at least one additional local distributed FBB voltage generation system.

5. An electrical system, comprising:

a functional unit block (FUB) including field effect transistors (FETs);

a constant differential voltage generator; and a distributed body bias generator to receive a set of differential signals from the constant differential voltage generator and provide at least one body bias signal to at least some of the FETs of the FUB;

an additional FUB including FETs; and an additional distributed body bias generator to receive a set of the differential signals from the constant differential voltage generator and provide at least one body bias signal to at least some of the FETs of the additional FUB such that the at least some of the FETs of the additional FUB have a constant forward body bias.

6. The electrical system of claim 5, wherein the set of differential signals includes a reference signal Vref and a reduced voltage signal Vred and the at least some FETs include PFETs having a body bias voltage Vbbp, and wherein the FUB has a power supply voltage Vcc, and wherein the body bias generator provides voltage Vbbp such that a voltage difference between Vcc and Vbbp is essentially equal to a voltage difference between Vref and Vred.

7. The electrical system of claim 6, wherein the set of differential signals includes a ground signal Vss and the at least some FETs include NFETs having a body bias voltage Vbbn, and wherein the FUB has a ground signal Vss, and wherein the body bias generator provides voltage Vbbn such that a voltage difference between Vbbn and Vss of the FUB is essentially equal to a voltage difference between Vred and Vss of the set of differential signals.

8. The electrical system of claim 6, wherein the set of differential signals includes an additional reduced voltage signal Vred2 and a ground signal Vss and the at least some FETs include NFETs having a body bias voltage Vbbn, and wherein the FUB has a ground signal Vss, and wherein the body bias generator provides voltage Vbbn such that a voltage difference between Vbbn and Vss of the FUB is essentially equal to a voltage difference between Vred2 and Vss of the set of differential signals.

9. The electrical system of claim 5, wherein the set of differential signals includes a reduced voltage signal Vred and a ground signal Vss and the at least some FETs include NFETs having a body bias voltage Vbbn, and wherein the FUB has a ground signal Vss, and wherein the body bias generator provides voltage Vbbn such that a voltage difference between Vbbn and Vss of the FUB is essentially equal to a voltage difference between Vred and Vss of the set of differential signals.

10. The electrical system of claim 9, wherein the ground signal Vss of the set of differential signals is the same as the ground signal Vss of the FUB.

11. The electrical system of claim 5, further comprising an additional FUB including FETs and the distributed body bias generator provides the at least one body bias signal to at least some of the FETS of the additional FUB.

12. The electrical system of claim 5, wherein the distributed body bias generator includes current mirror circuitry.

13. The electrical system of claim 5, wherein the constant differential voltage generator operates in different modes and the set of differential signals have different values in the different modes.

14. The electrical system of claim 5, wherein the FUB, constant differential voltage generator, and distributed body bias generator are on a single die.

15. The electrical system of claim 5, wherein the FETs include PFETs and NFETs and the distributed body bias generator provides one body bias signal to forward body bias the PFETs and another body bias signal to forward body bias the NFETs.

16. The electrical system of claim 5, wherein the constant differential voltage generator includes voltage reduction circuitry and a constant voltage generator to provide at least one reference signal to the voltage reduction circuitry, and wherein the voltage reduction circuitry includes at least one voltage divider to provide at least one reduced voltage signal to the set of differential signals.

17. The electrical system of claim 5, wherein the constant differential voltage generator includes voltage reduction circuitry and a constant voltage generator to provide at least one reference signal to the voltage reduction circuitry, and wherein the voltage reduction circuitry includes one voltage divider for one reduced voltage signal of the set of differential signals and another voltage divider for another voltage signal of the set of differential signals.

18. The electrical system of claim 5, further comprising:

an additional FUB including FETs;

an additional constant differential voltage generator; and an additional distributed body bias generator to receive an additional set of differential signals from the additional constant differential voltage generator and provide at least one body bias signal to at least some FETs of the additional FUB such that the at least some of the FETs of the additional FUB have a constant forward body bias.

19. The electrical system of claim 5, wherein the distributed body bias generator includes current mirror circuitry having a voltage to current unit and at least one current to voltage unit.

20. The electrical system of claim 5, wherein the distributed body bias generator includes multiple current to voltage units.

21. An electrical system, comprising:

first and second functional unit blocks (FUBs) each including field effect transistors (FETs);

a constant differential voltage generator; and first and second distributed body bias generators to each receive a set of differential signals from the constant differential voltage generator, the first distributed body bias generator being coupled to the first FUB to provide at least one body bias signal to at least some of the FETs of the first FUB such that the at least some of the FETs have a constant forward body bias, and the second distributed body bias generator being coupled to the second FUB to provide at least one body bias signal to at least some of the FETs of the second FUB such that the at least some of the FETs have a constant forward body bias.

22. The electrical system of claim 21, wherein the first and second distributed body bias generators receive the same set of differential signals.

23. The electrical system of claim 21, wherein the first and second distributed body bias generators receive a different set of differential signals.

24. The electrical system of claim 21, wherein the set of differential signals includes a reference signal Vref and a reduced voltage signal Vred and the at least some FETs include PFETs having a body bias voltage Vbbp, and wherein the FUBs have a power supply voltage Vcc, and wherein the body bias generator provides voltage Vbbp such that a voltage difference between Vcc and Vbbp is essentially equal to a voltage difference between Vref and Vred.

25. The electrical system of claim 24, wherein the set of differential signals includes a ground signal Vss and the at least some FETs include NFETs having a body bias voltage Vbbn, and wherein the FUBs have a ground signal Vss, and wherein the body bias generator provides voltage Vbbn such that a voltage difference between Vbbn and Vss of the FLUB is essentially equal to a voltage difference between Vred and Vss of the set of differential signals.

26. The electrical system of claim 24, wherein the set of differential signals includes an additional reduced voltage signal Vred2 and a ground signal Vss and the at least some FETs include NFETs having a body bias voltage Vbbn, and wherein the FUBs have a ground signal Vss, and wherein the body bias generator provides voltage Vbbn such that a voltage difference between Vbbn and Vss of the FUBs is essentially equal to a voltage difference between Vred2 and Vss of the set of differential signals.

27. The electrical system of claim 21, wherein the set of differential signals includes a reduced voltage signal Vred and a ground signal Vss and the at least some FETs include NFETs having a body bias voltage Vbbn, and wherein the FUBs have a ground signal Vss, and wherein the body bias generator provides voltage Vbbn such that a voltage difference between Vbbn and Vss of the FUB is essentially equal to a voltage difference between Vred and Vss of the set of differential signals.

28. The electrical system of claim 21, wherein the distributed body bias generator includes current mirror circuitry.

29. The electrical system of claim 21, wherein the constant differential voltage generator operates in different modes and the set of differential signals have different values in the different modes.

30. The electrical system of claim 21, wherein the FUB, constant differential voltage generator, and distributed body bias generators are on a single die.

31. The electrical system of claim 21, wherein the constant differential voltage generator includes voltage reduction circuitry and a constant voltage generator to provide at least one reference signal to the voltage reduction circuitry.

32. The electrical system of claim 21, further comprising:

third and fourth FUBs each including FETs;

a second constant differential voltage generator; and third and fourth distributed body bias generators to each receive a set of differential signals from the second constant differential voltage generator, the first distributed body bias generator being coupled to the first FUB to provide at least one body bias signal to at least some of the FETs of the third FUB such that the at least some of the FETs have a constant forward body bias, and the second distributed body bias generator being coupled to the fourth FUB to provide at least one body bias signal to at least some of the FETs of the fourth FUB such that the at least some of the FETs have a constant forward body bias.

33. An electrical system, comprising:

first, second, third, and fourth functional unit blocks (FUBs) each including field effect transistors (FETs);

first and second constant differential voltage generators; and first and second distributed body bias generators to each receive first and second sets of differential signals from the first constant differential voltage generator, the first distributed body bias generator being coupled to the first FUB to provide at least one body bias signal to at least some of the FETs of the first FUB such that the at least some of the FETs of the first FUB have a constant forward body bias, and the second distributed body bias generator being coupled to the second FUB to provide at least one body bias signal to at least some of the FETs of the second FUB such that the at least some of the FETs of the second FUB have a constant forward body bias; and third and fourth distributed body bias generators to each receive third and fourth sets of differential signals from the second constant differential voltage generators, the third distributed body bias generator being coupled to the third FUB to provide at least one body bias signal to at least some of the FETs of the third FUB such that the at least some of the FETs of the third FUB have a constant forward body bias, and the fourth distributed body bias generator being coupled to the fourth FUB to provide at least one body bias signal to at least some of the FETs of the fourth FUB such that the at least some of the FETs of the fourth FUB have a constant forward body bias.

34. An electrical system, comprising:

a functional unit block (FUB) including field effect transistors (FETs);

a constant differential voltage generator; and a distributed body bias generator to receive a set of differential signals from the constant differential voltage generator and provide at least one body bias signal to at least some of the FETs of the FUB, wherein the set of differential signals includes a reduced voltage signal Vred and a ground signal Vss and the at least some FETs include NFETs having a body bias voltage Vbbn, and wherein the FUB has a ground signal Vss, and wherein the body bias generator provides voltage Vbbn such that a voltage difference between Vbbn and Vss of the FUB is essentially equal to a voltage difference between Vred and Vss of the set of differential signals.

35. An electrical system, comprising:

a functional unit block (FUB) including field effect transistors (FETs);

a constant differential voltage generator; and a distributed body bias generator to receive a set of differential signals from the constant differential voltage generator and provide at least one body bias signal to at least some of the FETs of the FUB, wherein the distributed body bias generator includes current mirror circuitry.

36. An electrical system, comprising:

a functional unit block (FUB) including field effect transistors (FETs);

a constant differential voltage generator; and a distributed body bias generator to receive a set of differential signals from the constant differential voltage generator and provide at least one body bias signal to at least some of the FETs of the FUB, wherein the constant differential voltage generator includes voltage reduction circuitry and constant voltage generator to provide at least one reference signal to the voltage reduction circuitry, and wherein the voltage reduction circuitry includes at least one voltage divider to provide one reduced voltage signal to the set of differential signals.

37. An electrical system, comprising:

a functional unit block (FUB) including field effect transistors (FETs);

a constant differential voltage generator; and a distributed body bias generator to receive a set of differential signals from the constant differential voltage generator and provide at least one body bias signal to at least some of the FETs of the FUB; wherein the set of differential signals includes a reference signal Vref and a reduced voltage signal Vred and the at least some FETs include PFETs having a body bias voltage Vbbp, and wherein the FUB has a power supply voltage Vcc, and wherein the body bias generator provides voltage Vbbp such that a voltage difference between Vcc and Vbbp is essentially equal to a voltage difference between Vref and Vred.

* * * * *

UNITED STATES PATENT AND TRADEMARK OFFICE

CERTIFICATE OF CORRECTION

PATENT NO. : 6,366,156 B1
DATED : April 2, 2002
INVENTOR(S) : Narendra et al.

It is certified that error appears in the above-identified patent and that said Letters Patent is hereby corrected as shown below:

Column 6,
Line 45, delete “12”, insert -- I2 --.
Line 65, delete “13”, insert -- I3 --.

Column 7,
Line 1, delete “13”, insert -- I3 --.

Signed and Sealed this

Sixth Day of August, 2002

*Attest:*

*Attesting Officer*

JAMES E. ROGAN
*Director of the United States Patent and Trademark Office*